United States Patent [19]

Martin et al.

[11] Patent Number: 4,648,488

[45] Date of Patent: Mar. 10, 1987

[54] ELEVATOR SYSTEM

[75] Inventors: Matthew Martin, Randolph; Richard H. Ludwig, West Caldwell, both of N.J.

[73] Assignee: Westinghouse Electric Corp., Pittsburgh, Pa.

[21] Appl. No.: 741,401

[22] Filed: Jun. 5, 1985

[51] Int. Cl.[4] ..... B66B 1/46

[52] U.S. Cl. ..... 187/126; 187/124; 187/133

[58] Field of Search ..... 187/29 R; 340/19 R, 340/20

[56] References Cited

U.S. PATENT DOCUMENTS

| | | | |
|---|---|---|---|
| 3,506,096 | 4/1970 | Robaszkiewicz | 187/29 |
| 3,814,214 | 6/1974 | Booker, Jr. | 187/29 R |
| 3,952,837 | 4/1976 | Rice | 187/29 R |

*Primary Examiner*—William M. Shoop, Jr.
*Assistant Examiner*—Richard K. Blum
*Attorney, Agent, or Firm*—D. R. Lackey

[57] ABSTRACT

An elevator system, and method of operating same, in which the existence of a stuck call button is detected, the call initiated by a stuck call button is prevented from interfering with elevator service to the remaining floors, and predetermined or reduced partial service is provided to the floor associated with the stuck pushbutton while the stuck button problem persists.

12 Claims, 13 Drawing Figures

ELEVATOR SYSTEM

BACKGROUND OF THE INVENTION

1. Field of the Invention

The invention relates in general to elevator systems, and more specifically to methods and apparatus for handling stuck call pushbuttons in an elevator system.

2. Description of the Prior Art

Elevator call pushbuttons are exposed to mechanical damage and they occasionally become stuck in the "on" position. When this happens, the elevator car that answers the call will be unable to reset it. The car may then sit at the floor, opening and closing its doors indefinitely, degrading elevator service to the remaining floors of the building, as well as unnecessarily subjecting the electromechanical door operator to excess use.

SUMMARY OF THE INVENTION

Briefly, the present invention detects the existence of a stuck call pushbutton by determining if the same call is present immediately after it has been reset. When a stuck pushbutton is detected, its associated call is prevented from being considered by the elevator system by immediately masking the call. In order not to exclude the associated floor from elevator service entirely, reduced or partial service is provided for the floor on a predetermined schedule. To prevent needlessly sending a car to the floor of a stuck pushbutton, however, the predetermined schedule is operative only when there is elevator activity in the building, e.g., at least one elevator car must already be busy serving a call for elevator service, or the number of hall calls in the building must exceed a predetermined count value, as desired. In other words, the system would not start an idle elevator car and sent it to the floor of the masked call.

BRIEF DESCRIPTION OF THE DRAWINGS

The invention may be better understood and further advantages and uses thereof more readily apparent, when considered in view of the following detailed description of exemplary embodiments, taken with the accompanying drawings, in which:

FIG. 2 is a flow chart of a program which may be used to tabulate and update floor enables or cutouts for the various floors of the building in which the elevator system is installed;

DESCRIPTION OF PREFERRED EMBODIMENTS

Figure 1:
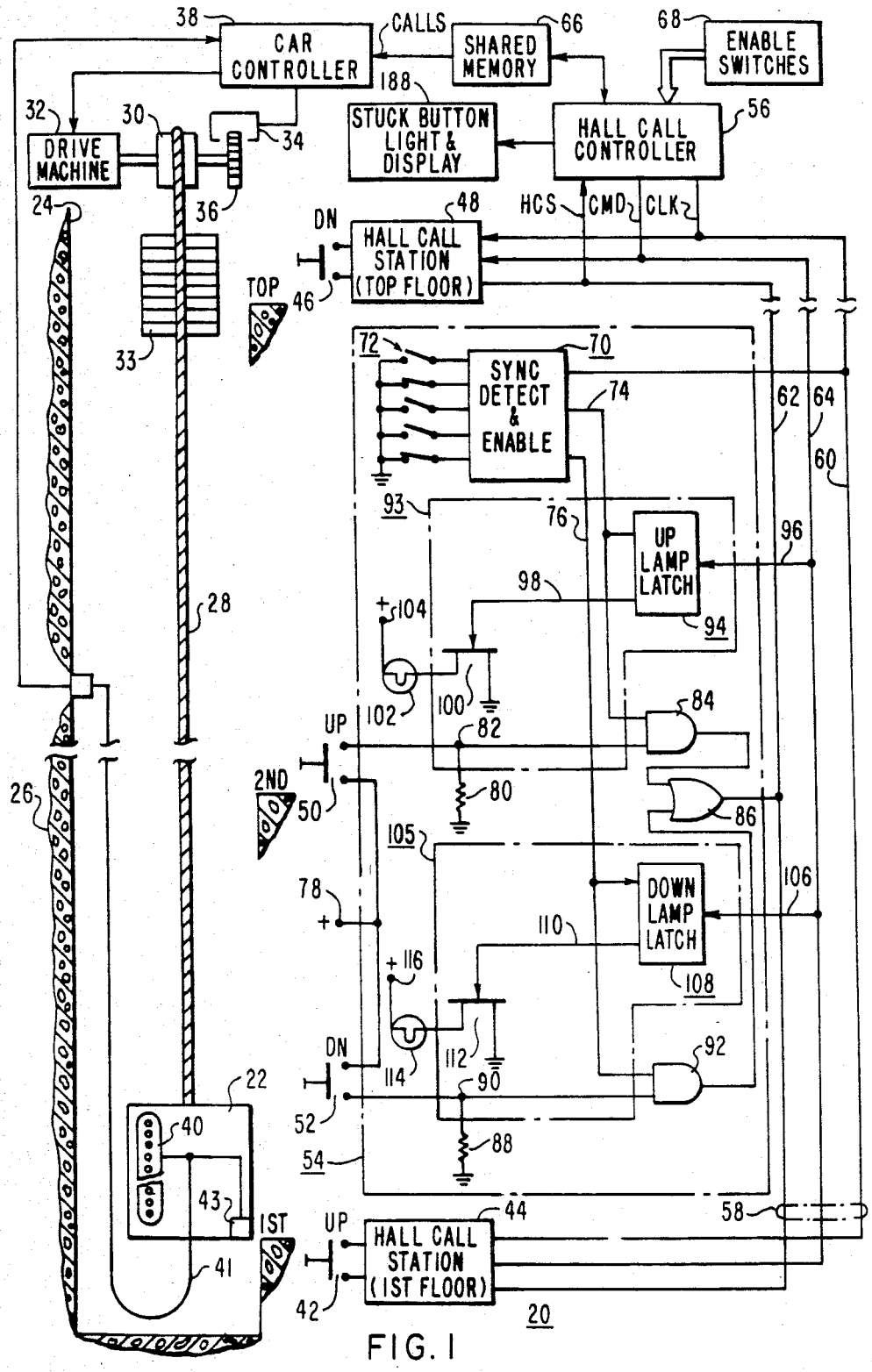

Referring now to the drawings, and to FIG. 1 in particular, there is shown an elevator system 20 which may be constructed to utilize the teachings of the invention. U.S. Pat. Nos. 3,750,850 and 3,804,209 may be referred to to obtain details of an operative elevator system, which details are not shown in FIG. 1. These patents are hereby incorporated into the present application by reference. Only that part of the elevator system 20 which is necessary in order to understand the present invention will be described in detail.

Elevator system 20 includes one or more elevator cars, such as car 22. When a plurality of cars are in system 20, they may be controlled by a group supervisory controller or system processor (not shown) which includes the strategy for operating the cars efficiently. Since each of the elevator cars of a bank or cars, and the controls therefore, would be similar in construction and operation, only the controls for car 22 are illustrated in FIG. 1. More specifically, elevator car 22 is mounted in a hoistway 24 for movement relative to a structure 26 having a plurality of floors or landings, with only the first, second and top floors being shown in order to simplify the drawing. Elevator car 22 is supported by a plurality of wire ropes 28, which are reeved over a traction drive sheave 30 mounted on a shaft of a traction drive machine 32 having an AC or DC drive motor. A counterweight 33 is connected to the other ends of the ropes 28. A pickup 34 detects movement of the car 22 through the effect of circumferentially spaced openings in a pulse wheel 36 driven with the drive sheave 30, or with a governor sheave (not shown). The openings in the pulse wheel are spaced to provide a pulse for each standard increment of travel of car 22, such as a pulse for each 0.25 inch of car travel. Pickup 34 provides pulses for a car controller 38 which includes a floor selector and a speed pattern generator.

Car calls, as registered by pushbutton array 40 mounted in the car 22 are directed to the car controller 38 via a traveling cable 41. Signals from landing control 43 are also directed to the car controller via the traveling cable 41.

Hall calls are registered by pushbuttons and associated hall call stations mounted in the hallways, such as the up hall call pushbutton 42 and associated hall call station 44 located at the bottom or first floor, the down hall call pushbutton 46 and associated hall call station 48 located at the top floor, and the up and down hall call pushbuttons 50 and 52, respectively, and associated hall call station 54, located at the second and other intermediate floors.

The car controller 38 keeps track of the car location, and the calls for service for the elevator car. Controller 38 provides a request-to-accelerate signal ACC to the speed pattern generator to initiate a run, and it provides a deceleration signal DEC for the speed pattern generator at the precise time required to decelerate the car according to a predetermined deceleration speed pattern and stop at a target floor for which a call for service has been registered.

Since each of the hall call stations are of similar construction, only hall call station 54 for the second floor is shown in detail in FIG. 1.

More specifically, each hall call station, such as hall station 54, is connected to a supervisory hall call controller 56 via a three-conductor hall call bus 58 having first, second and third communication lines 60, 62 and 64, respectively. The functions of the hall call controller 56 may be performed by one or more microcomputers, as desired, with a microcomputer including the usual central processing unit (CPU), random-access memory (RAM), read-only-memory (ROM), and input and output communication ports. The hall call controller 56 places timing signals on the first communication line 60, which function as synchronizing signals for successively enabling the various pushbuttons and lamps of the hall call stations. Thus, hall calls placed on the second communication line 62 from a hall call station are properly synchronized into the associated time slot which identifies the hall call station. Lamp turn-on requests placed on the third communication line 64 when the hall call controller 56 recognizes a call, are also properly synchronized into the correct time slot. The hall call controller 56, in addition to recognizing hall calls and requesting that the associated lamp be energized to indicate recognition, also maintains a hall call table which will also be referred to as a call status table. For ease in transferring new hall calls to the car controller 38, or to a group supervisory controller, the call status table is maintained in a random-access memory 66 which is shared by the car controller 38, or a group supervisory controller, as the case may be. For example, the car controller 38 consults memory 66 and compares a prior image of the call status table with the latest status to detect the setting of new hall calls.

In many elevator systems, floors may be enabled and/or removed from elevator service, as desired, from a traffic director's station or other central location, merely by setting and resetting floor related enable switches 68. The hall call controller 56 takes into account floors which have been disabled or cut out by the enable switches 68 before it prepares a lamp turn-on request as part of a serial signal CMD applied to the third communication line 64, and before it sets a corresponding bit in the call status table of memory 66.

Hall call station 54 includes synchronization detection and enable means 70, such as a comparator. Means 70 monitors serial addresses CLK which are on the first communication line 60, by comparing these signals with its own unique binary address set by switches 72, such as thumb switches. When means 70 detects its own unique address, it enables output line 74 by driving it high for the first half of the time slot, and then it enables output line 76 by driving it high for the remaining half cycle of the time slot.

When up pushbutton 50 is actuated, a voltage source 78 appears across a resistor 80 at a terminal 82. The cycle time for processing all of the enabling time slots for the pushbuttons associated with the hall call stations is short enough that button 50 will be actuated while the up enable line 74 goes high. Thus, the output of an AND gate 84 goes high for the duration of the enable signal, and an OR gate 86 applies a logic one signal to data line 62. Data line 62 provides a serial signal HCS to the hall call controller 56. Hall call controller 56 will recognize a logic one in the first half of the time slot, as an up hall call from the second floor.

In like manner, when the down hall call pushbutton 52 is actuated, a source voltage 78 appears across a resistor 88 at a terminal 90, and an AND date 92 applies a logic one signal to the input of the OR gate 86, which in turn applies a synchronized logic one signal to communication data line 62.

When hall call controller 56 recognizes a new hall call, and the hall call originates from an enabled floor, as determined by the position of its associated enable switch in the group of switches 68, it sets an appropriate bit in the call status table located in shared memory 66. Controller 56 also outputs a synchronized bit on the third communication line 64 as part of a serial signal CMD. If the hall call originated from the up pushbutton 50, when the up service enable line 74 goes high lamp driver means 93 is enabled. For example, the high signal on line 74 may enable an up lamp latch 94, such as a flip-flop, and while latch 94 is enabled a synchronized logic one signal in the serial signal CMD will be applied to the input line 96 of latch 94. This high input signal is latched and applied to output line 98. The high output on line 98 turns on a solid state switch 100, such as a field effect transistor, energizing up hall call indicator lamp 102 from a suitable voltage source 104. As long as this up hall call is active, a high synchronized signal will be applied to the input of latch 94, maintaining the energization of lamp 102. When this hall call is served, controller 56 will reset the appropriate bit in the call status table located in shared memory 66, and controller 56 removes the logic one signal from the appropriate time slot of CMD. Thus, the output of latch 94 will then go low when latch 94 is enabled, and the low signal will be clocked to its output line 98, turning switch 100 off and deenergizing lamp 102.

In like manner, when pushbutton 52 initiates a new down hall call, and floor #2 is enabled by the appropriate switch in the group of enable switches 68, the hall call controller 56 sets an appropriate bit in the call status table, and it sets a synchronized bit in the serial signal CMD on line 64 associated with the lamp driver means 105. Lamp driver means 105 includes a latch 108, with input line 106 of latch 108 going to a logic one while its enable input is held high by enable line 76. The high input on line 106 is transferred to an output line 110 which turns on a solid state switch 112 to energize a down hall call indicator lamp 114 from a voltage source 116.

In accordance with the teachings of the invention, if any of the call pushbuttons should stick and continuously register a call, the stuck button is detected, a stuck button indicator light and floor number display 188 is energized, the call associated with the stuck button is prevented from interfering with normal elevator service to the remaining floors, and reduced or partial service is provided to the floor associated with the stuck button until the problem corrects itself or is corrected by service personnel.

Figure 2A:
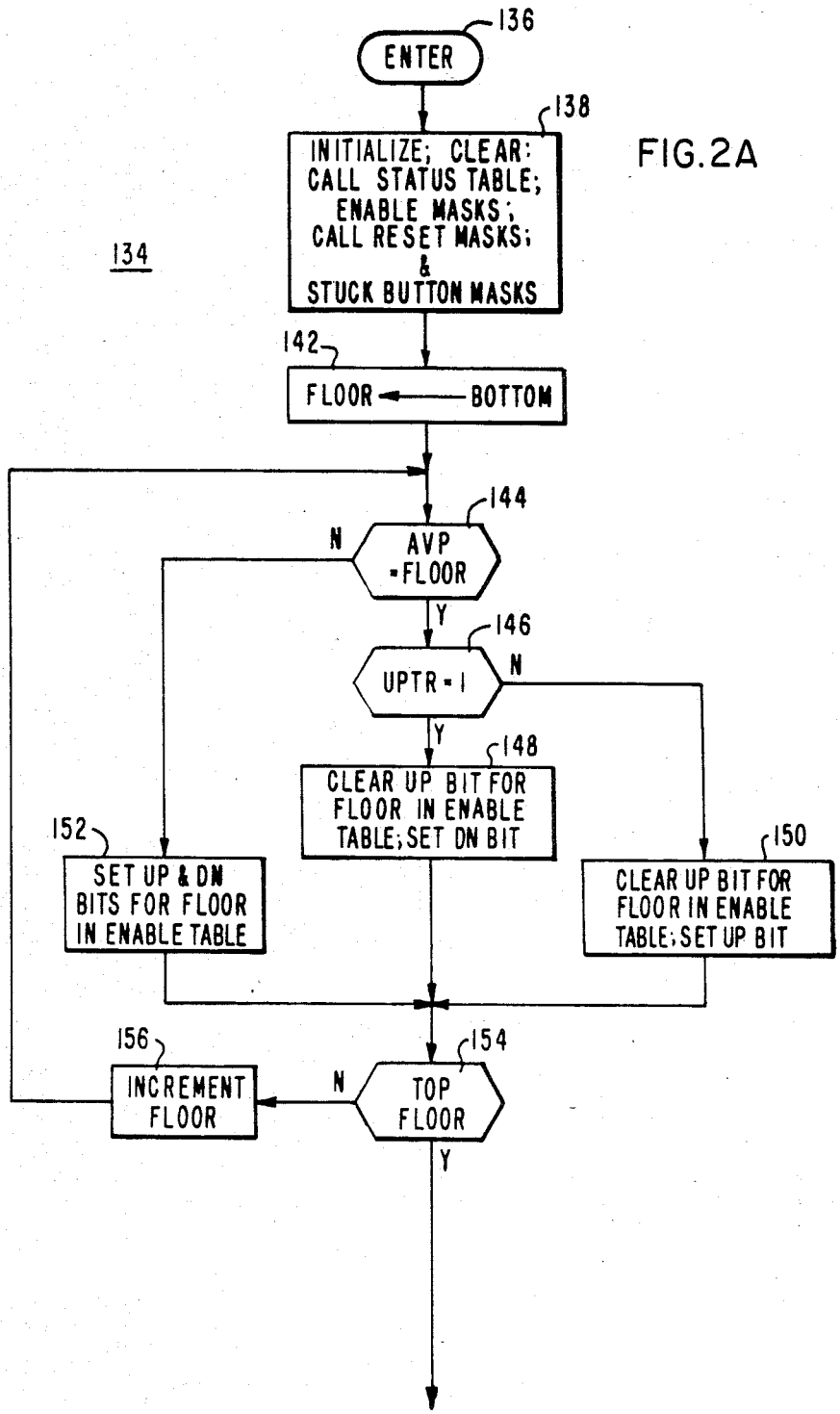
FIGS. 2A and 2B are a schematic diagram of an elevator system which may be constructed and operated according to the teachings of the invention.
Figure 2B:
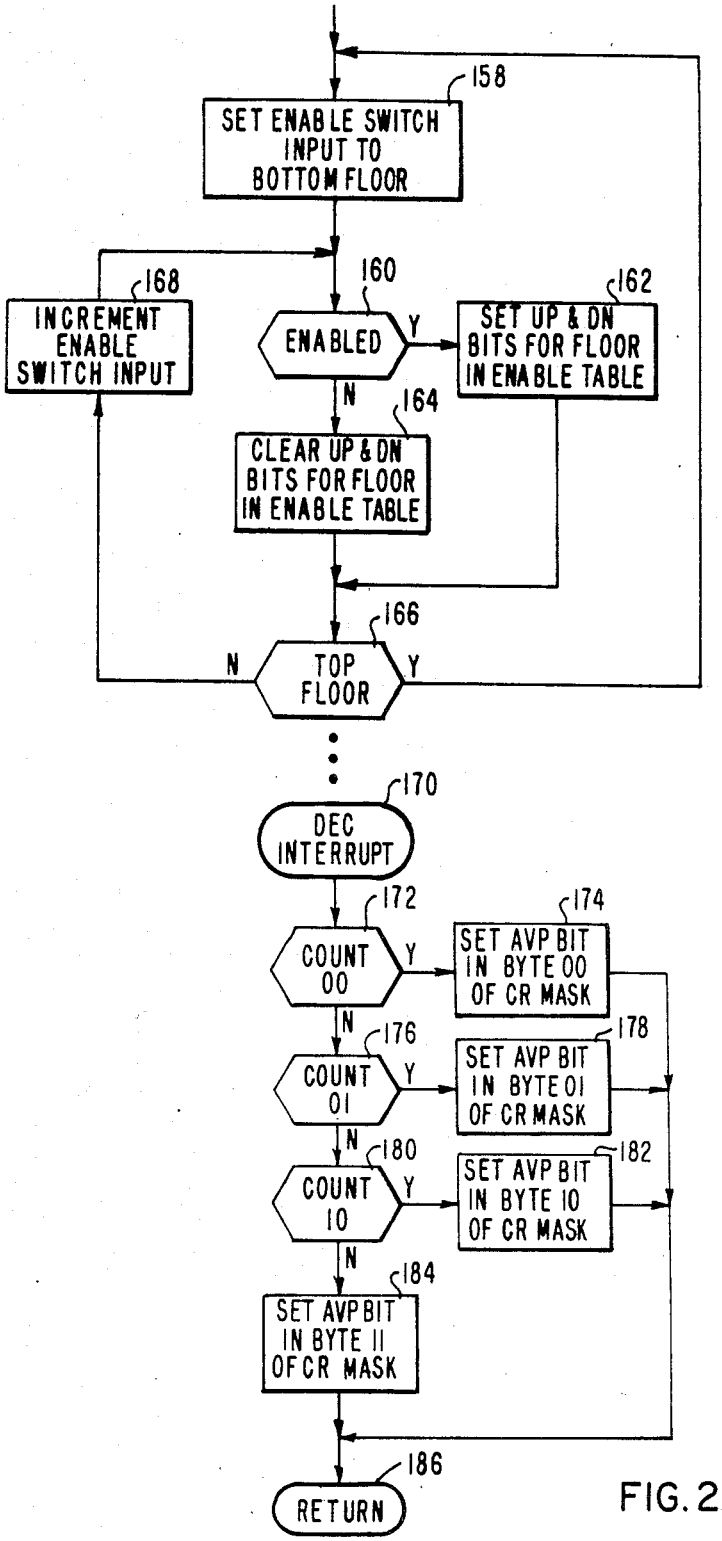

FIG. 2 is a flow chart of a program 134 which may be run by the hall call controller 56 to detect new inputs from enable switches 68, and to update enable tables which continuously set forth the current enable status of all of the floors of building 26. A separate dedicated microcomputer in controller 56 may update the enables according to the program 134 of FIG. 2. Program 134 is entered at input 136. Step 138 initializes the controller, such as be clearing the hall status table shown in FIG. 7, clearing the enable masks shown in FIG. 4, clearing the call reset mask shown in FIG. 5, and clearing the stuck button masks shown in FIG. 6. The tables which store these masks may utilize similar formats, each having a plurality of bytes synchronized by a software byte counter shown in the RAM map of FIG. 3. For example, the first byte may be up calls from the first 8 floors of the building, the next byte may be down calls from the first 8 floors, etc.

Figure 4:
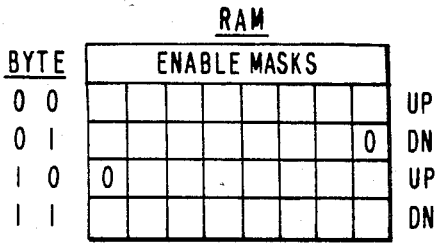
FIG. 4 is a RAM map of an enable table referred to in the program of FIG. 2, which contains enable masks.
Figure 5:
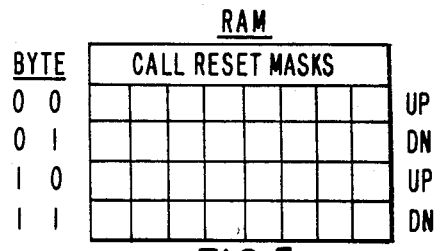
FIG. 5 is a RAM map of a call reset table which contains call reset masks.

Steps 142 through 156 initialize the floor enable table shown in FIG. 4, according to car position. The hall call pushbutton associated with the advanced car position AVP and car travel direction UPTR is disabled, in order to reset a call which may have been registered therefrom, and all other pushbuttons are enabled. The advanced car position of a stationary car is its actual floor location, and the advanced car position of a moving car is the floor ahead at which the car can make a normal stop according to a predetermined deceleration schedule.

More specifically, step 142 starts the floor enable table initialization procedure by setting a variable FLOOR to the binary address of the bottom floor. Step 144 compares the binary address defined by the advanced car position signal AVP with FLOOR to determine if they are equal. If they are, step 146 checks the cars present or last travel direction by examining signal UPTR. If this signal is a logic one, the car is set for up travel, and step 148 clears, i.e., disables the up bit for FLOOR in the floor enable table shown in FIG. 4, and it sets, i.e., enables, the down bit for FLOOR, unless FLOOR is the bottom floor. If step 146 finds UPTR is not a logic one, step 150 clears the down bit and sets the up bit for FLOOR in the enable table shown in FIG. 4. If step 144 finds AVP and FLOOR do not match, step 152 sets the up and down bits for FLOOR in the enable table FET. Steps 148, 150 and 152 all proceed to step 154 to determine if the whole table has been processed. If not, step 154 proceeds to step 156 which increments FLOOR, and step 156 returns to step 144. When the enables table shown in FIG. 4 has been completely initialized according to car position, step 154 proceeds to step 158.

Steps 158 through 168 form a loop which continuously updates the enable table shown in FIG. 4 according to the positions of the floor cutout or enable switches 68 shown in FIG. 1. Step 158 initializes the input to check the enable switch associated with the bottom floor. Step 160 checks the position of the switch. If the switch is in the floor enable position, step 162 sets the up and down bits for this floor in the enable table. If the switch is in the cutout or disabled position, step 164 clears the up and down bits for this floor. Steps 162 and 164 both proceed to step 166 to determine if the complete table has been processed. If it has not been completely processed, step 168 increments the enable switch input and the program returns to step 160. If the enable table has been completely processed, the program returns to step 158 to start a new update for the complete table. This loop continues until interrupted by an elevator car entering the slowdown phase of a run to land at a target floor.

The slowdown phase for an elevator car may be signaled by the associated car controller 38 providing a true deceleration signal DEC. Thus, when DEC goes true, the microcomputer is vectored to location 170, and step 172 checks the byte count. If it is binary 00, step 174 sets the bit of byte 00 in the call reset mask table shown in FIG. 5, which bit corresponds to the advanced car position AVP of the elevator car. For example, if the car is traveling upwardly and its AVP is the fifth floor, step 174 would set bit position 4 of byte 00. Step 174 then returns to the interrupted program at 186. If step 172 finds that the count is not 00, the program advances to step 176 which checks to see if the byte count is binary 01. If it is, step 178 sets the AVP bit in byte 01 of the call reset mask table shown in FIG. 5. If step 176 finds that the count is not 01, the program advances to step 180 which checks to see if the count is binary 10. If it is, step 182 sets the AVP bit in byte 10 of the call reset mask table. If step 180 finds that the count is not 10, it must be binary 11, in the present example, and step 184 will set the AVP bit in byte 11 of the call reset mask table.

Figure 8A:
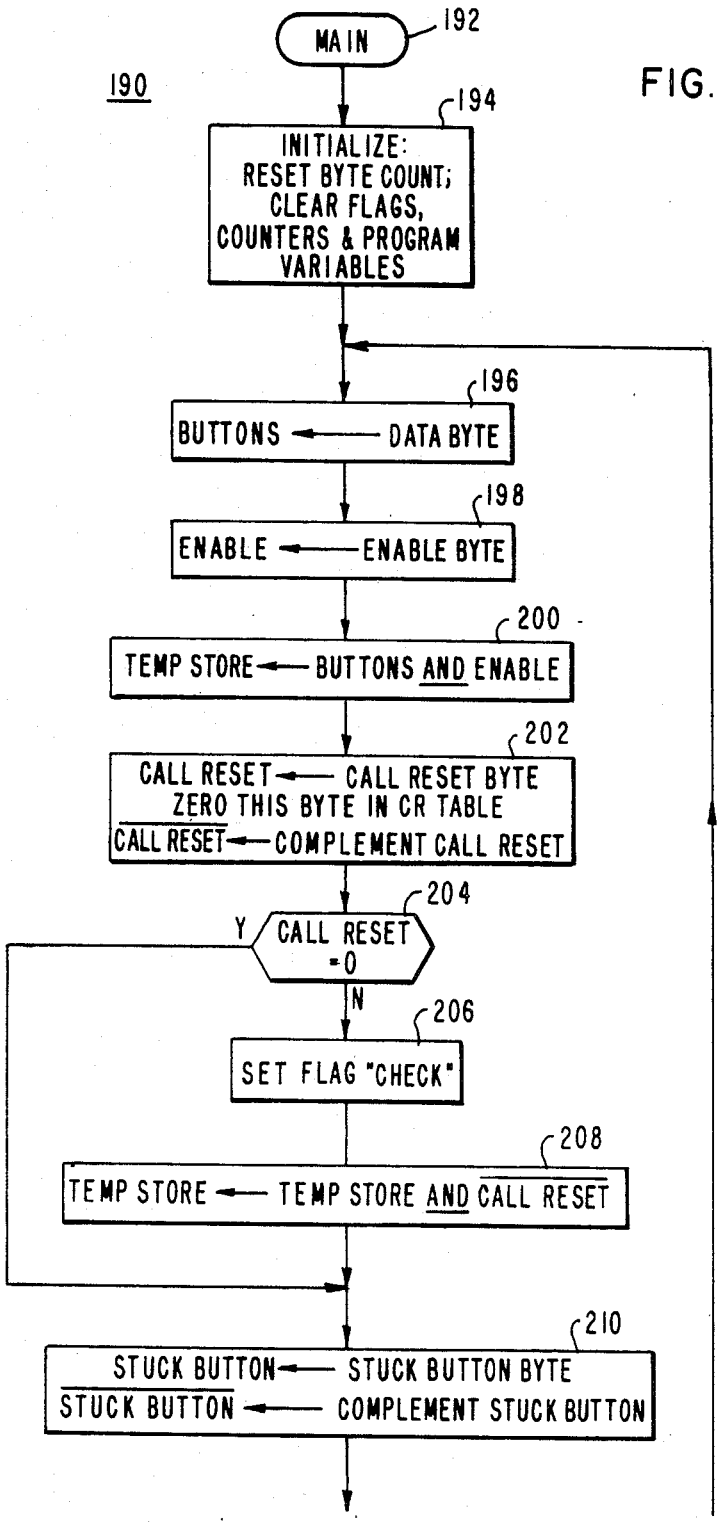
FIGS. 8A and 8B are a flow chart of a program which provides logic formulated according to the teachings of the invention for detecting stuck buttons, and for handling calls associated therewith.
Figure 8B:
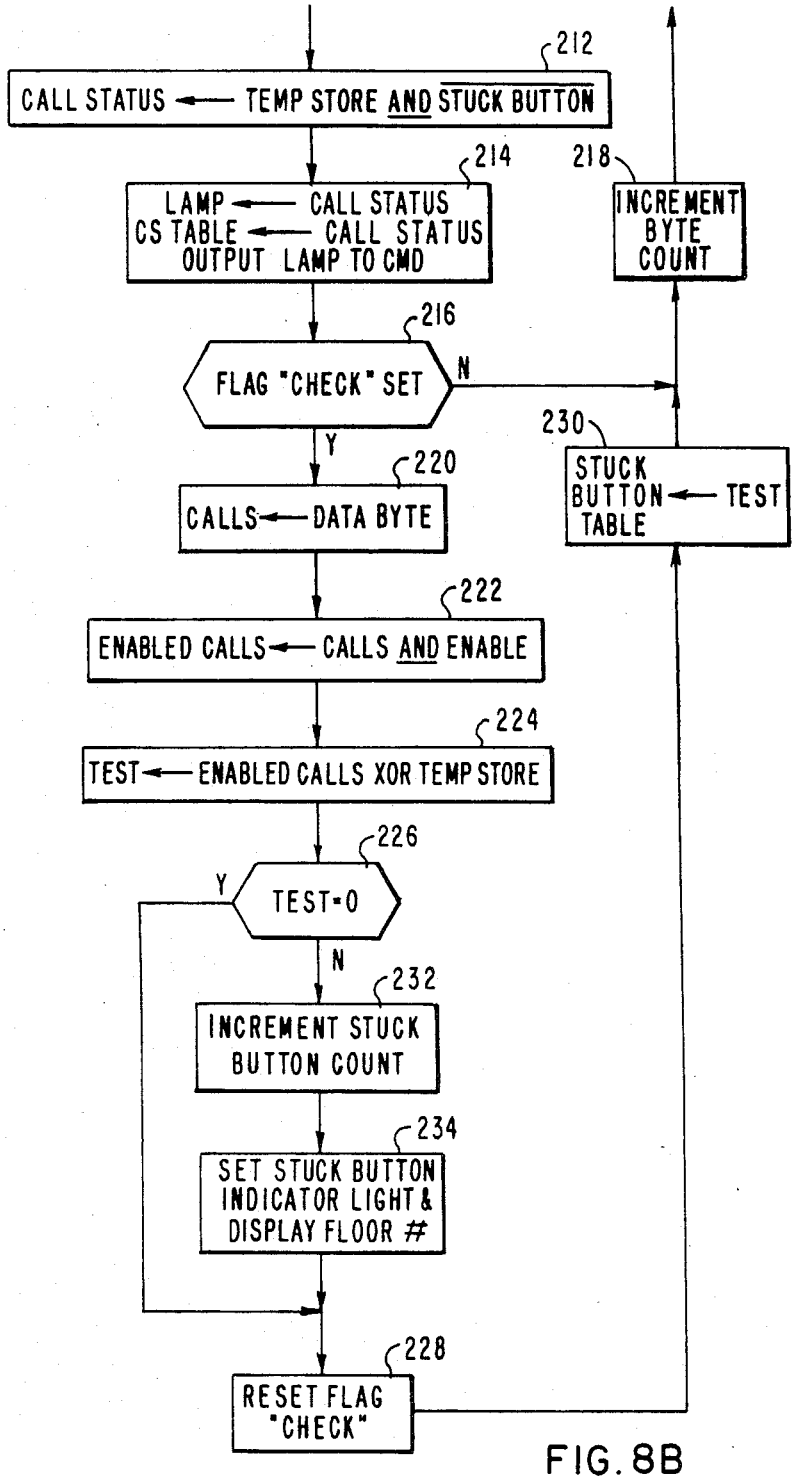

FIG. 8 is a flow chart of a program 190 which contains logic formulated according to the teachings of the invention to detect and handle stuck buttons, and their associated calls, according to a predetermined strategy. Program 190 is entered at 192, and step 194 initializes the program flags, counters and other program variables.

Step 196 reads serial signal HCS from conductor 62 of FIG. 1 and stores a predetermined byte thereof, according to the present byte count. This byte is stored at location BUTTONS of the RAM map shown in FIG. 3.

Figure 3:
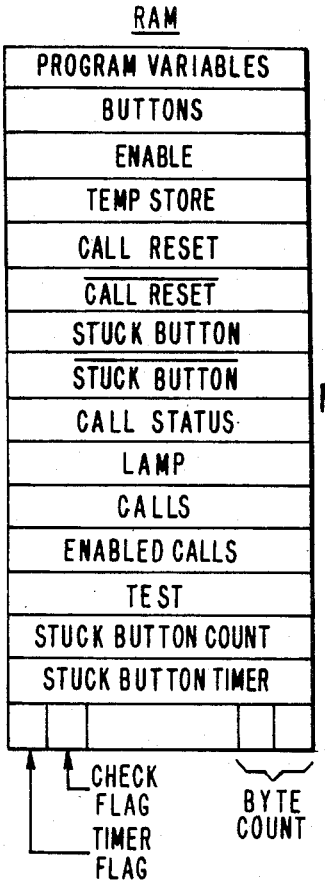
FIG. 3 is a RAM map setting forth program variables utilized by the program shown in in FIG. 2.

Step 198 retrieves an enable byte from the enable table shown in FIG. 4, according to the current byte count, and it stores this byte at location ENABLE of the RAM map shown in FIG. 3.

Step 200 performs a logical AND using the contents of BUTTONS and ENABLE, and it stores the result at location TEMP STORE shown in the RAM map of FIG. 3. BUTTONS contains hall calls, and the hall calls are screened by the enable masks, with TEMP STORE now containing hall calls for only the enabled floors.

Step 202 retrieves the byte associated with the present byte count from the call reset table, and it stores this byte at a location CALL RESET in the RAM map of FIG. 3. The byte position from which this byte is retrieved from the call reset table is then zeroed. Byte CALL RESET is logically complemented and stored at location $\overline{\text{CALLRESET}}$ in the RAM map of FIG. 3.

Step 204 checks to see if any calls were reset in the present call reset byte being considered, by checking to see if CALL RESET is equal to zero. If CALL RESET is not equal to zero, step 206 sets a flag CHECK in the RAM map of FIG. 3, and step 208 removes the reset calls by performing a logical AND with TEMP STORE and $\overline{\text{CALLRESET}}$. The result of this logical AND is stored at location TEMP STORE, which now contains the hall calls of the byte being considered, after being screened by the floor cutouts and call resets.

Figure 6:
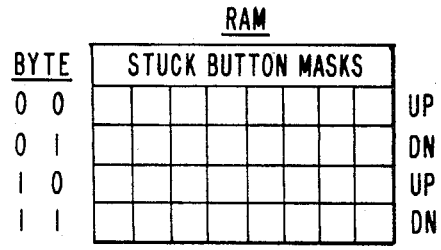
FIG. 6 is a RAM map of a stuck button table which contains stuck button masks.

Step 210 then retrieves the byte associated with the present byte count from the stuck button table shown in FIG. 6, which contains stuck button masks. Step 210 stores this byte at location STUCK BUTTON in the RAM map of FIG. 3, and step 210 also logically complements this byte and stores it at location $\overline{\text{STUCKBUTTON}}$.

Step 212 then screens calls from stuck pushbuttons by performing a logical AND with the contents of TEMP STORE and $\overline{\text{STUCKBUTTON}}$. The result of this logical function is stored at location CALL STATUS in the RAM map of FIG. 3. Thus, location CALL STATUS not contains the hall calls after they have been screened by the floor cutouts, call resets, and any stuck buttons which may be in the system.

Figure 7:
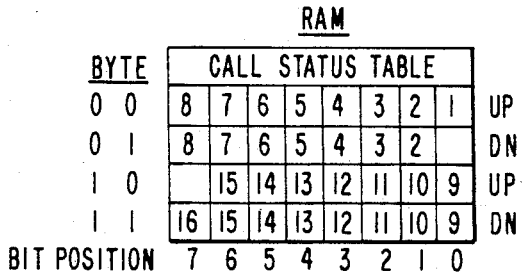
FIG. 7 is a RAM map of a call status table, which may be stored in the shared memory shown in FIG. 1.

Step 214 stores the contents of CALL STATUS in the call status table shown in FIG. 7, so that the car controller 38 can detect new hall calls by consulting the shared memory 66. The contents of CALL STATUS is also stored at location LAMP in the RAM map of FIG. 3. The contents of LAMP are synchronously applied to conductor 64 shown in FIG. 3, as part of the command signal CMD, which energizes the pushbuttons associated with recognized hall calls.

Step 216 then consults the flag CHECK shown in FIG. 3, to determine if any calls have been reset in the byte of the call reset table being considered. If the flag CHECK is not set, there are no hall calls reset in the current byte, and step 216 proceeds to step 218 which increments the byte count shown in FIG. 3. Step 218 then returns to step 196.

If step 216 finds that the flag CHECK has been set, the program then proceeds to a program portion which identifies stuck pushbuttons. The program identifies stuck pushbuttons by determining if a hall call which has been reset still persists just milliseconds after it has been reset. The first step of this check is shown in step 220, which stores the appropriate data byte from signal HCS at a temporary location CALLS shown in the RAM map of FIG. 3. If a pushbutton is stuck, the associated call will appear in this data byte, if the stuck pushbutton is associated with the data byte being considered. Step 222 then performs a logical AND with the contents of CALLS and the contents of ENABLE. The contents of ENABLE is still the same contents resulting from step 198. The result of the logic function performed in step 222 is stored at location ENABLED CALLS shown in FIG. 3, and step 224 performs the logical exclusive or function XOR with the contents of ENABLED CALLS and TEMP STORE. The contents of TEMP STORE is the contents resulting from step 208. The result of the logical XOR function is stored at location TEST shown in FIG. 3, and step 226 checks to see if the contents of location TEST is equal to zero. If the contents of TEST is equal to zero, it indicates that the hall calls which were reset, are still reset milliseconds later, indicating no stuck pushbuttons, If the contents of location TEST is zero, step 226 proceeds to step 228 which resets the flag CHECK, and step 230 stores the contents of TEST in the stuck button table, at the appropriate byte location, which table is shown in FIG. 6.

If the contents of table TEST is not equal to zero, it indicates that hall call appears in the data stream HCS at the same location where a hall call had just been reset, indicating that the pushbutton associated with the detected call is stuck. Step 232 then increments a stuck button count, which may be maintained by a software counter shown in the RAM map of FIG. 3, and step 234 sets the stuck button indicator light 188 shown in FIG. 1. Step 234 also displays the floor number associated with the stuck button. The stuck button count is utilized by a program shown in FIG. 9, and the stuck button indicator light and display notifies maintenance personnel that there is an active stuck button in the elevator call system, and the floor, or floors, affected. Step 234 then returns to step 228 which resets the flag CHECK and the byte TEST is stored in the stuck button table in step 230, which will now form the stuck button mask for screening the call from the stuck button from the call status table, as hereinbefore described relative to step 212. Thus, the program of FIG. 8 identifies stuck pushbuttons and it screens the associated call from a stuck pushbutton from the call status table.

Figure 9:
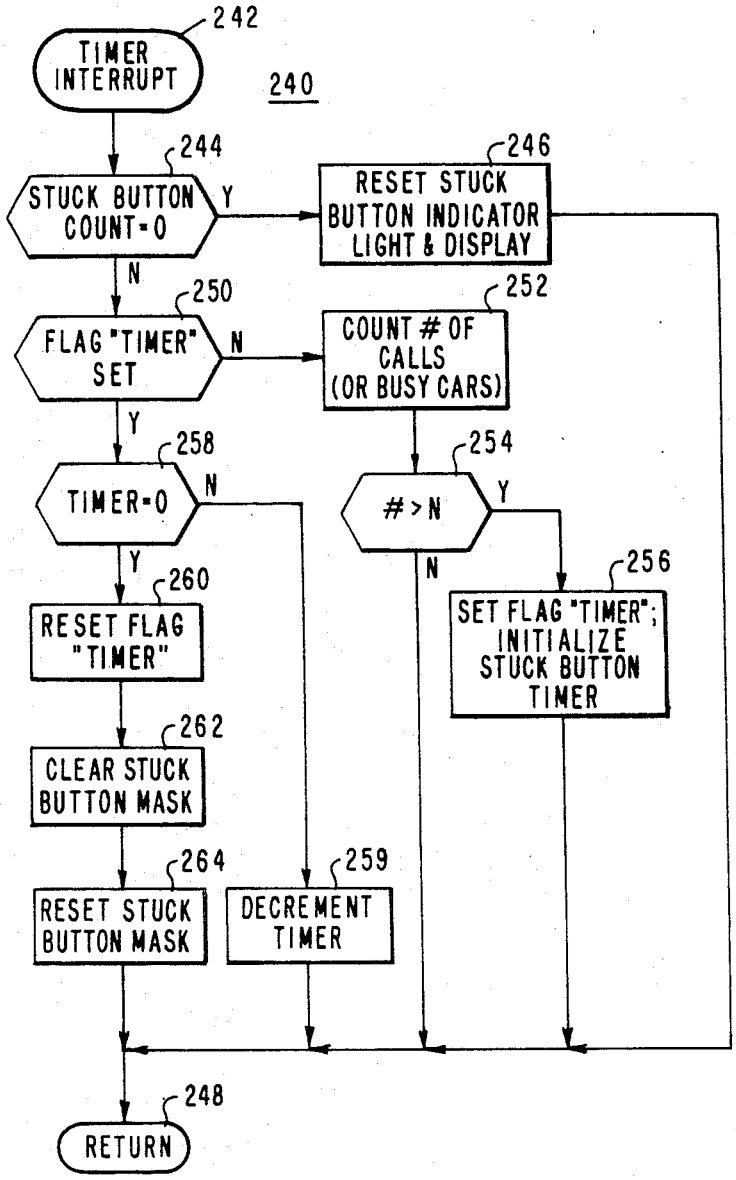
FIG. 9 is a flow chart of a timer program which may be used according to the teachings of the invention to provide partial or reduced elevator service to a floor associated with a stuck pushbutton.

FIG. 9 is a flow chart of a program 240 which provides reduced or partial service to the floor associated with the stuck pushbutton while the problem persists. Program 240 of FIG. 9 is entered at 242, such as being vectored to location 242 via a timer interrupt. Step 244 checks the stuck button count maintained in the RAM map of FIG. 3 to see if there are any active stuck pushbuttons. If the stuck button count is zero, step 244 proceeds to step 246 which resets the stuck button indicator light and display 188 shown in FIG. 1, and the program returns to the interrupted program at 248.

If step 244 finds that the stuck button count is not equal to zero, there is at least one active stuck pushbutton in the call system and the program advances to step 250 to see if a flag TIMER is set. This flag is also indicated in the RAM map of FIG. 3. The flag TIMER is used to indicate whether or not a timer has been started to time a stuck pushbutton. If the flag TIMER is not set, it indicates that a stuck pushbutton has been identified, but that an associated timer has not yet been started. Instead of immediately starting a timer for a stuck pushbutton, which will result in an elevator car being sent to the floor of the stuck pushbutton after a predetermined period of time, the program first checks to make sure that there is elevator activity in the building. In other words, if it is after the normal hours in which the elevator system is used, the program will not periodically send an elevator car to a floor associated with a stuck pushbutton. Step 252 may determine building activity in any one of several suitable ways, such as by counting the number of hall calls, or counting the number of busy cars. Step 254 checks to see if the count exceeds a predetermined number N. If the count does not exceed N, step 254 returns to the interrupted program at 248, and no service will be provided to the floor of the stuck pushbutton until building activity is detected.

If step 254 finds that the number of calls, or the number of busy cars exceeds the predetermined value N, the program advances to step 256 which sets the flag TIMER and initializes the stuck button timer, which may be a software timer set forth in the RAM map of FIG. 3. Step 256 then returns to the interrupted program at 248.

If step 250 finds that the timer flag has been set in a prior step 256, it indicates that the stuck button timer has been initialized for an identified stuck pushbutton, and the program branches from step 250 to step 258. Step 258 checks to see if the stuck button timer has timed out, and if it has not, step 259 decrements the stuck button timer and the program returns to the interrupted program at 248. If step 258 finds that the stuck button timer has timed out, step 260 resets the flag TIMER, step 262 clears the stuck button mask in the appropriate byte of the stuck button table shown in FIG. 6, and step 264 resets the stuck button count. Step 264 then returns to the interrupted program at 248. Thus, the next time step 212 is performed in FIG. 8, the call associated with the stuck pushbutton, if it is still stuck, will be allowed to enter the call status table shown in FIG. 7, and service will be provided to the floor associated with the stuck pushbutton. As soon as an elevator car has served this floor, the stuck pushbutton, if still active, will be identified and the associated call will again be screened from consideration for at least the time determined by the stuck button timer. Thus, if a stuck button becomes "freei", normal service will be restored to the associated floor, and the stuck button indicator light and display will be turned off the next time the timer times out.

Figure 10:
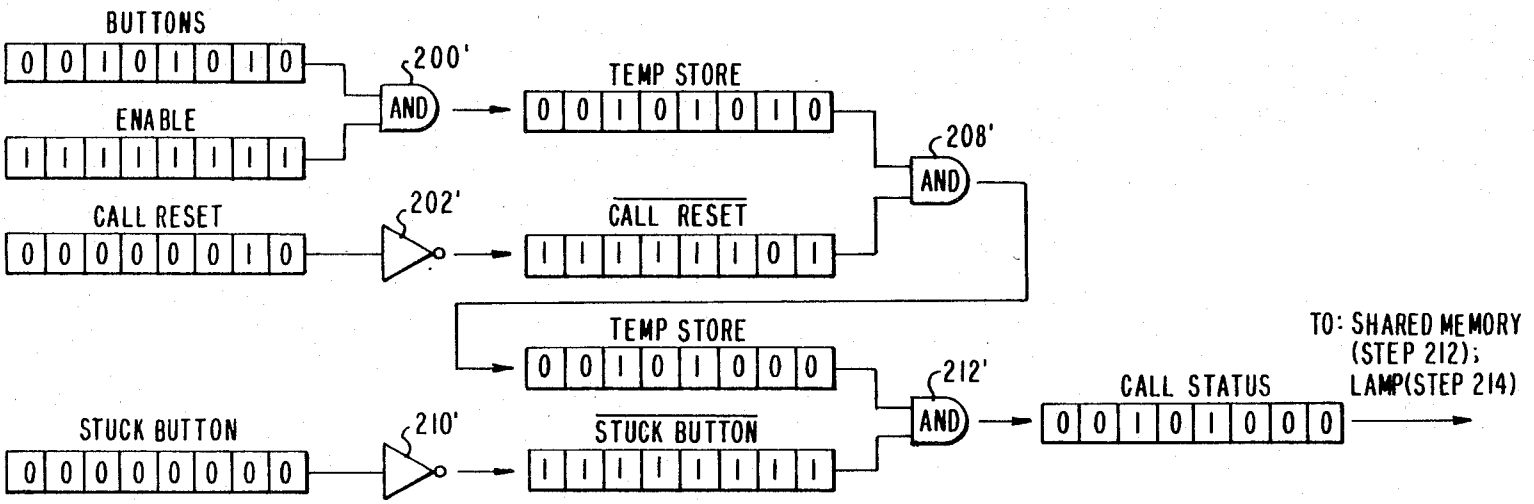
FIGS. 10 and 11 diagrammatically illustrate examples of the logic performed by the program shown in FIG. 8.
Figure 11:
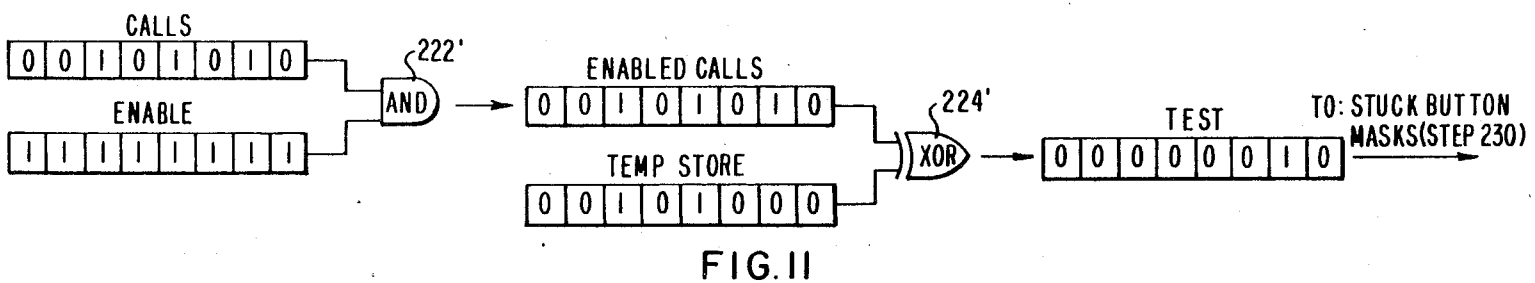

FIGS. 10 and 11 diagrammatically set forth an example of the logic performed by the program shown in FIG. 8. The logic functions shown in FIGS. 10 and 11 are given the same reference numerals as the associated program steps of FIG. 8, except for the addition of a prime mark. It will be assumed that the byte being considered is byte 00, and the location BUTTONS indicates up calls from the second, fourth and sixth floors. All of these floors are enabled, resulting in the logical AND 200' storing calls from the second, fourth, and sixth floors at location TEMP STORE. The call reset byte stored at CALL RESET indicates that the call at the second floor has been served and a bit has been set in the call reset masks in order to reset this call. The logical complement 202' results in the contents of $\overline{\text{CALL RESET}}$ being AND'ed with the contents of TEMP STORE, with the results being stored at TEMP STORE. The contents of TEMP STORE now indicates up hall calls from the fourth and sixth floors. At this point, no stuck buttons have been identified, and the stuck button byte from the stuck button masks will be all zeros which are complemented to all ones by the logical complement 210'. The logical AND 212' performed on the contents of TEMP STORE and $\overline{\text{STUCK BUTTON}}$ results in a byte having up calls at the fourth and sixth floors being stored in the call status table of the shared memory, and also being output to the pushbutton lamps to turn on or maintain, the lamps associated with the active hall calls.

FIG. 10 now illustrates the logic which checks for stuck pushbuttons, with the hall calls now appearing as signal HCS being stored at location CALLS, which byte is AND'ed with the contents of ENABLE. The results of logical AND 222' are stored at location ENABLED CALLS, and it will be noted that an up hall call appears at the second floor. The contents of ENABLED CALLS is exclusive OR'ed in XOR function 224' with the contents of TEMP STORE, with the result of this XOR function being stored at location TEST. It will be noted that the up hall call from the second floor results in a logic one being set at the appropriate bit position of TEST. The contents of TEST now forms a mask, which will screen the up call from the second floor from active consideration, at least until the stuck button timer has been actuated and timed out.

In summary, there has been disclosed a new and improved elevator system which effectively deals with stuck call pushbuttons without adding any hardware to a microcomputer-based hall call controller. A stuck pushbutton is identified as soon an elevator car first serves the floor associated with the stuck pushbutton, and the associated call is immediately masked to prevent it from interfering with normal elevator service to the remaining floors of the building. Periodic sevice is then provided to the floor associated with the masked call as long as the problem persists, at least while there is elevator activity in the building.

We claim as our invention:

1. An elevator system including at least one elevator car mounted in a building to serve the floors therein, pushbuttons for registering calls for elevator service, and control means for operating the elevator car to serve and reset said calls, the improvement comprising:

means for identifying a stuck pushbutton, means for masking a call initiated by a stuck pushbutton, and means for periodically providing elevator service to the floor associated with the stuck pushbutton.

2. The elevator system of claim 1 wherein the means for identifying a stuck pushbutton includes means for detecting the existence of a call from a pushbutton immediately after a call associated with the pushbutton has been reset.

3. The elevator system of claim 1 wherein the means for periodically providing elevator service to the floor includes means for unmasking the call initiated by a stuck pushbutton.

4. The elevator system of claim 3 wherein the means for unmasking the call initiated by a stuck pushbutton includes a timer, means for actuating the timer when a stuck pushbutton is identified, and means for unmasking the call initiated by a stuck pushbutton after a predetermined period of time.

5. The elevator system of claim 1 including counting means for counting the number of calls for elevator service in the building, with the means for periodically providing elevator service to a floor associated with a stuck pushbutton being responsive to said counting means, providing periodic service to the floor associated with the stuck pushbutton only when the hall count exceeds a predetermined value.

6. The elevator system of claim 1 including counting means for counting the number of active elevator cars in the building, with the means for periodically providing elevator service to a floor associated with a stuck pushbutton being responsive to said counting means, providing periodic service to the floor associated with a stuck pushbutton only when the car count exceeds a predetermined value.

7. A method of handling stuck call pushbuttons in an elevator system having at least one elevator car mounted in a building to serve and reset calls for elevator service, comprising the steps of:

resetting a call when it is served by an elevator car, detecting the existence of the same call immediately after the resetting step, identifying a call detected by said detecting step as being initiated by a stuck call pushbutton, preventing a call initiated by a stuck pushbutton from interfering with elevator service to the remaining floors, and providing reduced elevator service to the floor associated with the stuck pushbutton.

8. The method of claim 7 wherein the step of preventing a call initiated by a stuck pushbutton from interfering with elevator service to the remaining floors includes the steps of masking said call from consideration.

9. The method of claim 8 wherein the step of providing reduced elevator service to the floor associated with the stuck pushbutton includes the step of unmasking the masked call in response to predetermined conditions.

10. The method of claim 9 wherein the step of unmasking the masked call includes the step of timing the masked call, with the unmasking step being provided after a predetermined period of time.

11. The method of claim 9 wherein the step of unmasking the call includes the step of counting the number of calls which coexist in the building at any one time, and timing the masked call only when the count exceeds a predetermined value, with the unmasking step being provided after the timing step has timed said predetermined value.

12. The method of claim 9 wherein the step of unmasking the call includes the step of counting the number of active elevator cars in the building, and timing the masked call only when the count exceeds a predetermined value, with the unmasking step being provided after the timing step has timed said predetermined value.

* * * * *